US007278175B2

(12) United States Patent
Torres

(10) Patent No.: US 7,278,175 B2
(45) Date of Patent: Oct. 9, 2007

(54) TUB SKIRT PANEL SYSTEM

(75) Inventor: Ray C. Torres, Moreno Valley, CA (US)

(73) Assignee: Lasco Bathware, Inc., Anaheim, CA (US)

( * ) Notice: Subject to any disclaimer, the term of this patent is extended or adjusted under 35 U.S.C. 154(b) by 101 days.

(21) Appl. No.: 10/707,876

(22) Filed: Jan. 20, 2004

(65) Prior Publication Data

US 2005/0097667 A1 May 12, 2005

Related U.S. Application Data

(60) Provisional application No. 60/481,622, filed on Nov. 11, 2003.

(51) Int. Cl.
*A47K 3/02* (2006.01)

(52) U.S. Cl. ..... 4/584

(58) Field of Classification Search ..... 49/463, 49/465; 52/202.8, 202, 208, 213, 455, 514; 292/84, 87, 107, DIG. 38, DIG. 64, 91; 4/538, 4/548, 549, 584, 592, 593
See application file for complete search history.

(56) References Cited

U.S. PATENT DOCUMENTS

| | | | | |
|---|---|---|---|---|
| 2,841,795 | A * | 7/1958 | Pelicano | 4/592 |
| 3,028,603 | A | 4/1962 | Rodman | |
| 3,620,404 | A * | 11/1971 | Grasso | 220/477 |
| 4,290,154 | A | 9/1981 | Benjamin | |
| D278,360 | S | 4/1985 | Kohler, Jr. et al. | |
| 4,875,726 | A * | 10/1989 | Thau | 292/337 |
| D331,622 | S | 12/1992 | Dannenberg | |
| 5,182,821 | A | 2/1993 | Bufford et al. | |
| 5,208,924 | A | 5/1993 | Smith et al. | |
| 5,383,240 | A | 1/1995 | Weeks, Sr. | |
| 5,864,898 | A | 2/1999 | Knapp et al. | |
| 5,940,906 | A | 8/1999 | Halloran | |
| 6,363,546 | B1 | 4/2002 | Mateina | |
| 2004/0216225 | A1 * | 11/2004 | Booth et al. | 4/541.1 |

FOREIGN PATENT DOCUMENTS

| | | | |
|---|---|---|---|
| JP | 09056623 | A * | 4/1997 |
| JP | 2000217729 | A * | 8/2000 |

OTHER PUBLICATIONS

C-PL Series Specification Sheet.
Karp Handi-Access Door Specification Sheet.

* cited by examiner

*Primary Examiner*—Huyen Le
(74) *Attorney, Agent, or Firm*—Calfee, Halter & Griswold, LLP

(57) ABSTRACT

A system is provided for aesthetically covering access openings in a tub skirt when access to the interior of the skirt is not required. The system includes a bracket affixable to the tub skirt and a panel easily attachable to and detachable from the bracket. The panel, when attached, hides the bracket when viewed from the exterior of the tub skirt. Clips are used to attach the panel to said bracket. The system is an improvement over systems using velcro or brackets which are visible when a panel is in place.

26 Claims, 6 Drawing Sheets

TUB SKIRT PANEL SYSTEM

CROSS REFERENCE TO RELATED APPLICATIONS

This application claims the benefit of U.S. provisional patent application No. 60/481,622 filed on Nov. 11, 2003 the entirety of which is hereby incorporated by reference.

BACKGROUND OF INVENTION

Modern bathroom design favors a look with planer surfaces and configurations which minimize the visibility of unattractive space. Nowhere is this more noticeable than in the design of bathtubs and tub accessories. Traditional tubs had a shape matching their name, showing a curved exterior surface and exposed piping. Modern design provides more boxlike shape which hides piping and unattractive space beneath and around the bottom of the tub. A common way to provide this shape as part of a new tub system or often over the top of an older tub is to install a tub skirt. A tub skirt provides a flat, aesthetically pleasing front surface.

A tub skirt, while hiding unattractive space, also prevents access to this space. As a remedy, tub skirts have been provided with access openings. These openings provide access for cleaning or tub repair and to access motors and plumbing on Jacuzzi type tubs. When such activities are not occurring, the openings are covered. Common accessories used to cover these openings are decorative panels. U.S. Pat. No. 5,940,906 to Halloran discloses a skirt frame with a detachable panel. The panel is held in place with Velcro tabs. U.S. Pat. No. 5,804,898 to Kapp et al. discloses a skirt frame with a detachable panel. Velcro is used for attachment. U.S. Pat. No. 5,208,924 to Smith et al. discloses a skirt frame and mechanically attachable panel. These panels are attached by screws with caps.

Skirts are often provided without panels. In other cases, the panels provided with the skirts are not aesthetically pleasing and retrofitting is desired by the consumer. Common ways to attach aftermarket or retrofit panels in order to match new bathroom colors or the like is with velcro pads because they can be attached with an adhesive. However, velcro tends to lose holding force over time and cannot be cleaned easily. This lack of holding force is especially noticeable in Jacuzzi type tubs which include motors which vibrate the tub skirt slightly. Panels which are held in place with screws and caps are difficult to remove. Removal is a time consuming process. What is desired is a simple system which remains hidden from view, but can be used repeatedly without a loss in effectiveness.

SUMMARY OF INVENTION

A system is provided for aesthetically covering access openings in a tub skirt when access to the interior of the skirt is not required. The system includes a bracket affixable to the tub skirt and a panel easily attachable to and detachable from the bracket. The panel, when attached, hides the bracket when viewed from the exterior of the tub skirt. Clips, which may be integrally molded into the panel, are used to attach the panel to the bracket. The system is an improvement over systems using velcro or brackets which are visible when a panel is in place. The system is durable and can be cleaned easily. Additionally, the system does not loosen when the tub skirt is vibrated.

DETAILED DESCRIPTION

Figure 5:
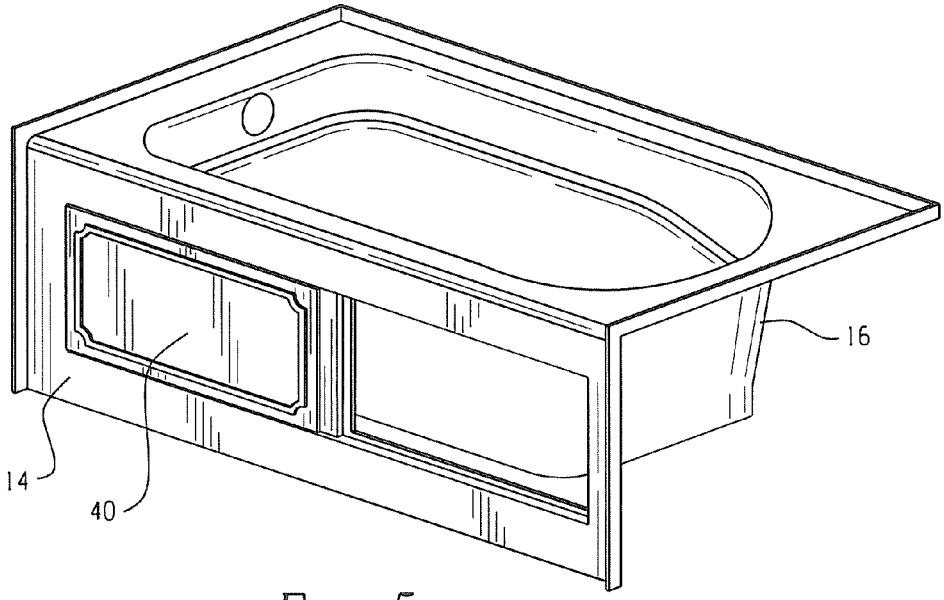
FIG. 5 is a perspective view of the system of FIG. 1.

As described in more detail below and shown in FIGS. 1 and 5, a system 10 for aesthetically covering access openings 12 in a tub skirt 14 is provided which includes a bracket 24 affixable to the tub skirt 14 and a panel 40 easily attachable to and detachable from the bracket 24. The panel 40 may be provided with aesthetic surface decoration upon its face. When in place and viewed from the exterior of the tub skirt 14, the bracket 24 is hidden from view by the panel 40.

The system 10 may be a part of or affixed to a tub skirt 14. The skirt 14 may be of a type known in the art, typically having a planer front face which defines one or more access openings 12. The skirt 14 may be used with any type of tub, but in a preferred embodiment of the invention the skirt 14 is used with a bath tub 16. Alternatively the system may be used with cabinets and access passages on walls to access plumbing for example. In yet another embodiment, the system does not cover an opening, but is placed upon a solid surface to match another system which is covering an opening. When used with a tub, the tub skirt 14 may be integrally formed with a bath tub 16 or may be provided separately. If separately provided, the skirt 14 is easily affixed over the top of the tub 16. The tub skirt 14 functions to provide a simple surface which is easy to clean and hides unattractive space around and beneath the tub 16. This space often has little use and may be distracting to the eye. In other cases, this space holds plumbing or motors which require periodic access. In a preferred embodiment of the invention, the tub skirt 14 has a length which is equivalent to length of the tub 16. However any size tub skirt 14 may be used in order to mesh with the architecture of the room in which the tub 16 is placed. In a preferred embodiment the tub skirt 14 extends from a single side of the tub 16 and hides that face of the tub from view. However, depending upon the way to tub 16 is positioned in a room, the skirt 14 may extend to hide any or all of the remaining three faces of the tub 16 as required by the architecture of the room.

Figure 1:
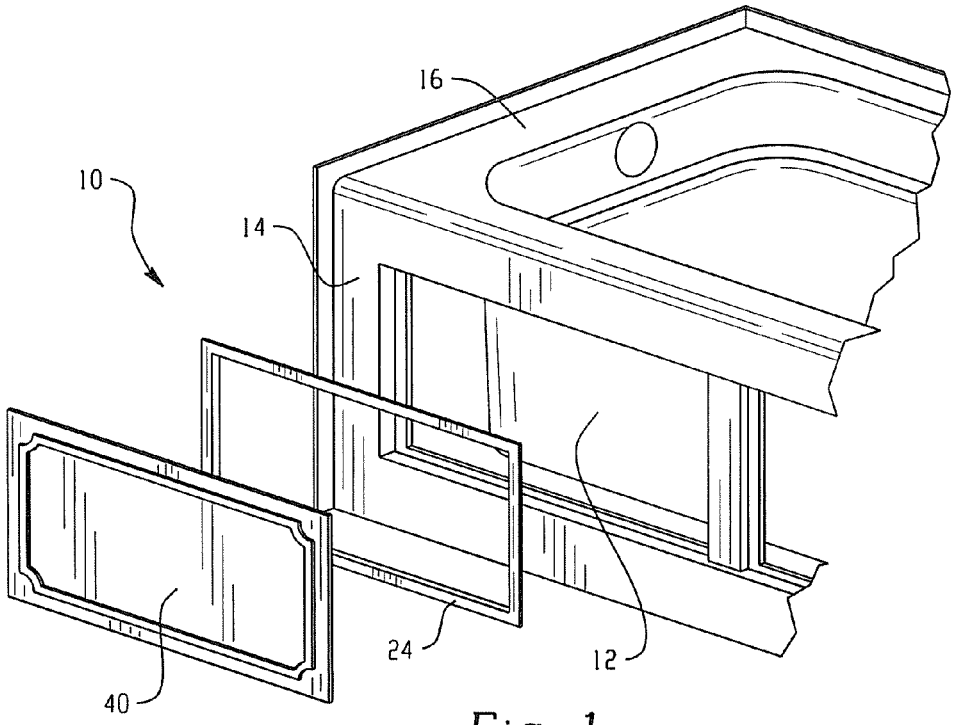
FIG. 1 is an exploded view of a system for aesthetically covering an access opening in a tub skirt.
Figure 2:
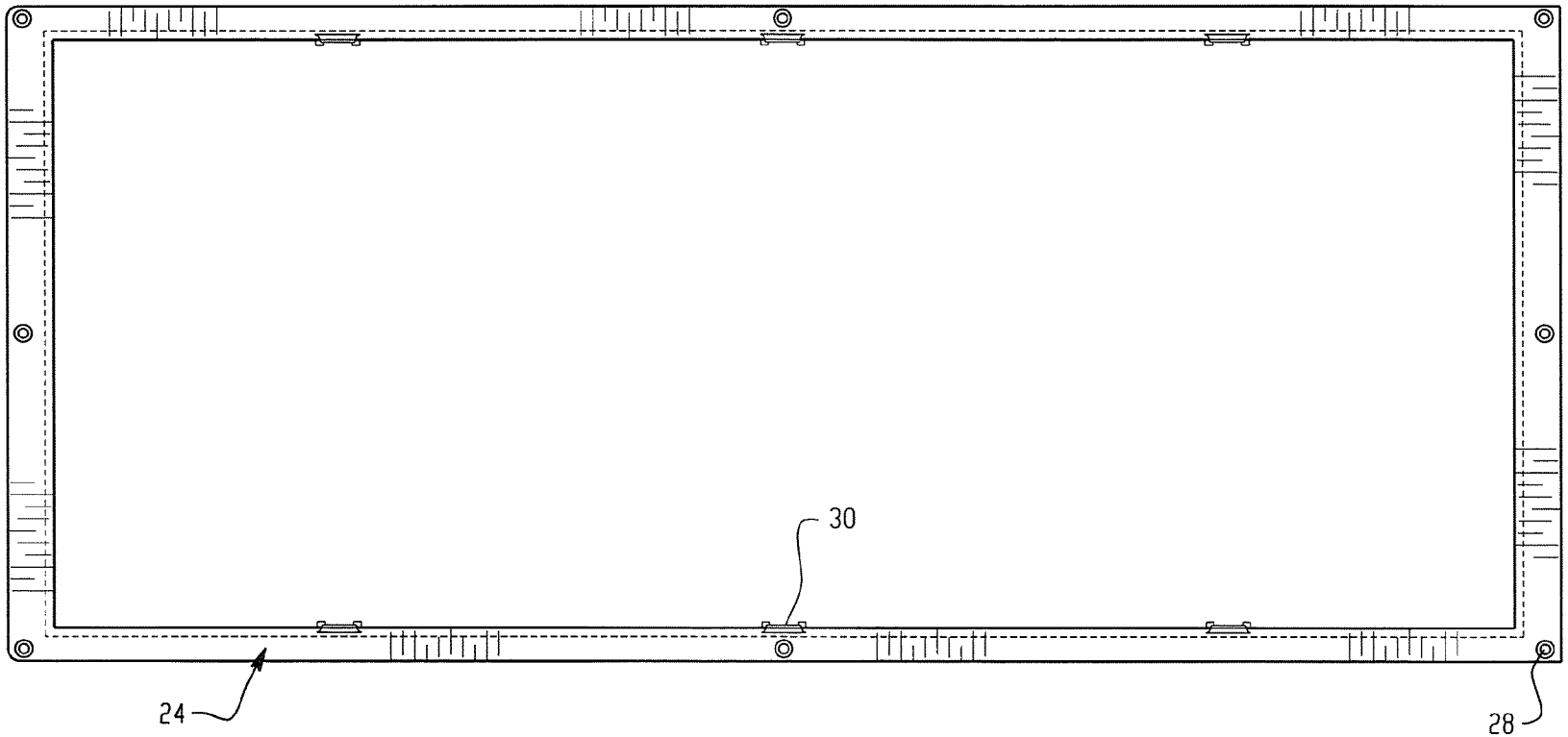
FIG. 2 is a front elevation view of a bracket within the system of FIG. 1.
Figure 6:
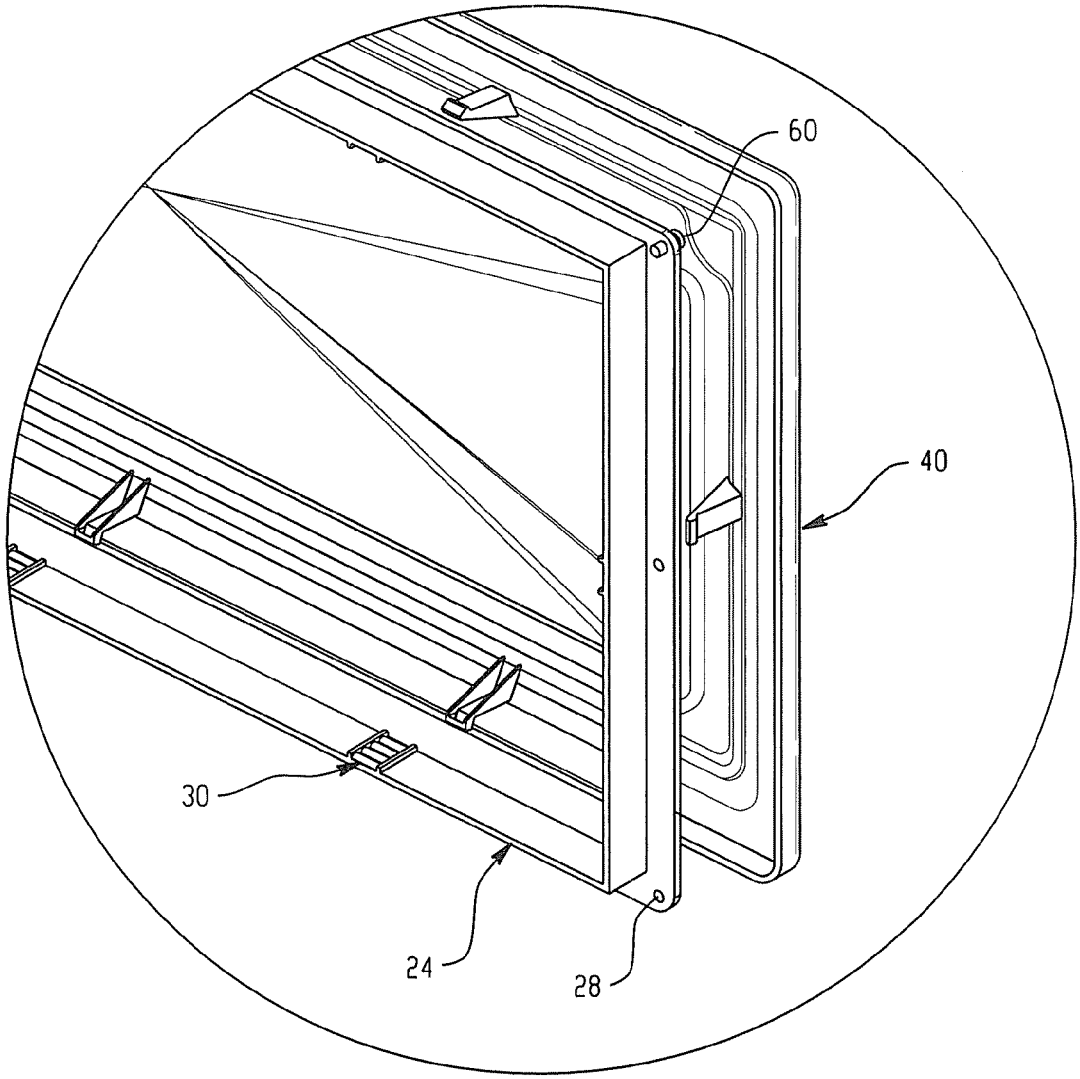
FIG. 6 is a perspective view of a section of an alternate system for aesthetically covering an access opening in a tub skirt.

Referring to FIGS. 1 and 2 a bracket 24 is shown having a rectangular shape. The bracket 24 may be any shape and may be provided in any number of pieces. Typical shapes include rectangular, square and a simulated tile shape. The shape of the bracket 24 is typically determined by the shape of the access opening 12 defined by the tub skirt 14. The bracket 24 includes four sides having a rectangular cross section, although any cross sectional shape may be used. The bracket 24 may be formed from plastic in a molding process, typically injection molding. The bracket 24 functions as a support for the panel 40 which covers the access opening 12 in the skirt 14. Preferably the bracket 24 may be affixed to the tub skirt 14 using rivets, but may also be affixed using glue or screws. The bracket 24 defines a plurality of apertures 28 for use in attaching the bracket 24 to the tub skirt 14. FIG. 6 shows a typical rivet 60 and apertures 28 within the bracket 24 to allow passage of the rivet 60. The bracket 24 may also be attached using glue or two-sided tape. The bracket 24 provides a support for the panel 40. Referring back to FIG. 1, the panel 40 may be easily attached and detached from the bracket 24. The bracket 24 is sized in accordance with the access opening 12 being covered by the panel 40. In a preferred embodiment of the invention the bracket 24 is affixed around the perimeter of the access opening 12. The bracket 24 may be affixed to the front face of the tub skirt 14, but is hidden from view when the panel 40 is in place.

Figure 3C:
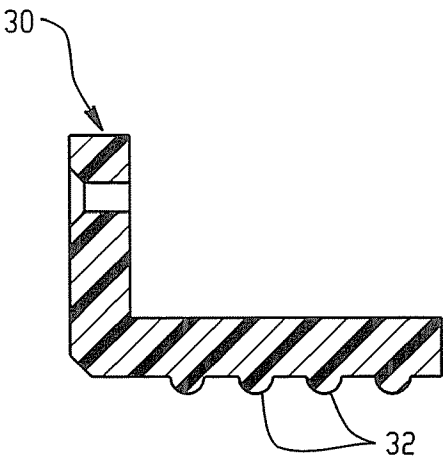
FIG. 3*c* is a cutaway view of a section of the bracket of FIG. 2.
Figure 3B:
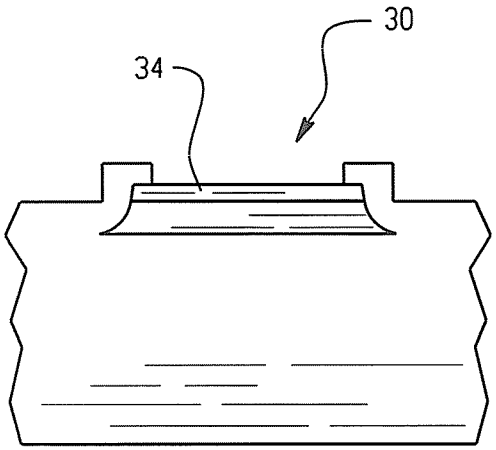
FIG. 3*b* is a side view of a section of the bracket of FIG. 2.
Figure 3A:
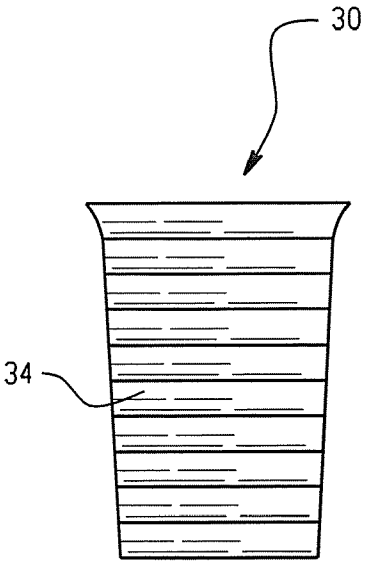
FIG. 3*a* is a bottom view of a section of the bracket of FIG. 2.
Figure 4B:
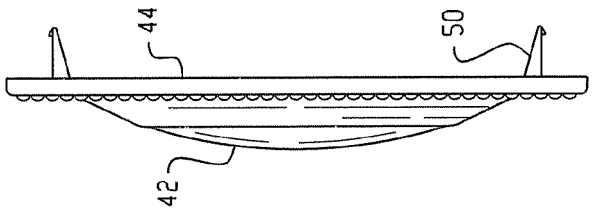
FIG. 4*b* is a side view of the panel of the system of FIG. 1.
Figure 4C:
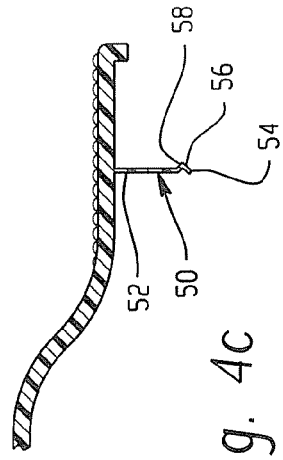
FIG. 4*c* is a cutaway view of a section of the panel of the system of FIG. 1.
Figure 4A:
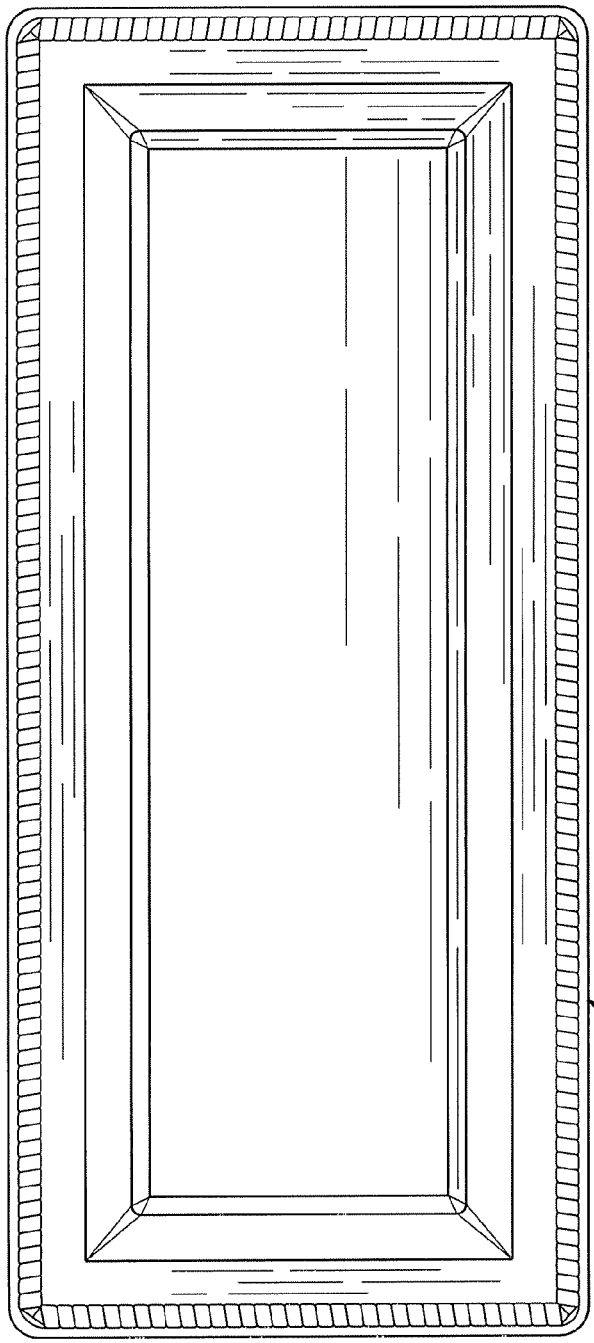
FIG. 4*a* is a front view of a panel of the system of FIG. 1.

The bracket 24 also defines a plurality of fastener mating surfaces 30 as shown in FIGS. 2, 3*a* through 3*c* and 6. Any number of fastener mating surfaces 30 may be placed on any edge of the bracket 24. FIG. 2 shows mating surfaces 20 on two sides of the bracket 24 while FIG. 6 shows mating surfaces 30 of four sides. A fastener mating surface 30 may have the shape of a tapered channel 34 as shown in FIG. 3*a*. The channel 34 may taper from a wider end at the front of the bracket 24 to a narrower end at the rear of the bracket 24. Thus, as the panel 40 is applied to the bracket 24 the mating surface 30 is easily located at its wide end. As the panel 40 is pushed into a locked position, a clip 50 upon the panel 40 progresses along the channel 34 to the narrower end. The panel 40 becomes aligned as the clip 50 reaches the narrow end. The mating surfaces 30 may be provided in a non-tapered version as well as shown in FIG. 6. The mating surface 30 includes a plurality of raised ridges 32. The raised ridges 32 function to engage clips 50 which are on the panel 40, thus holding the panel 40 in place. The raised ridges 32 preferably are molded as part of the bracket 24 upon its formation. The raised ridges 32 are oriented transversely to the direction of insertion of the panel 40 and its clips 50. As described in more detail below, the raised ridges 32 interact with the clips 50 to hold the panel 40 in place.

Figure 7B:
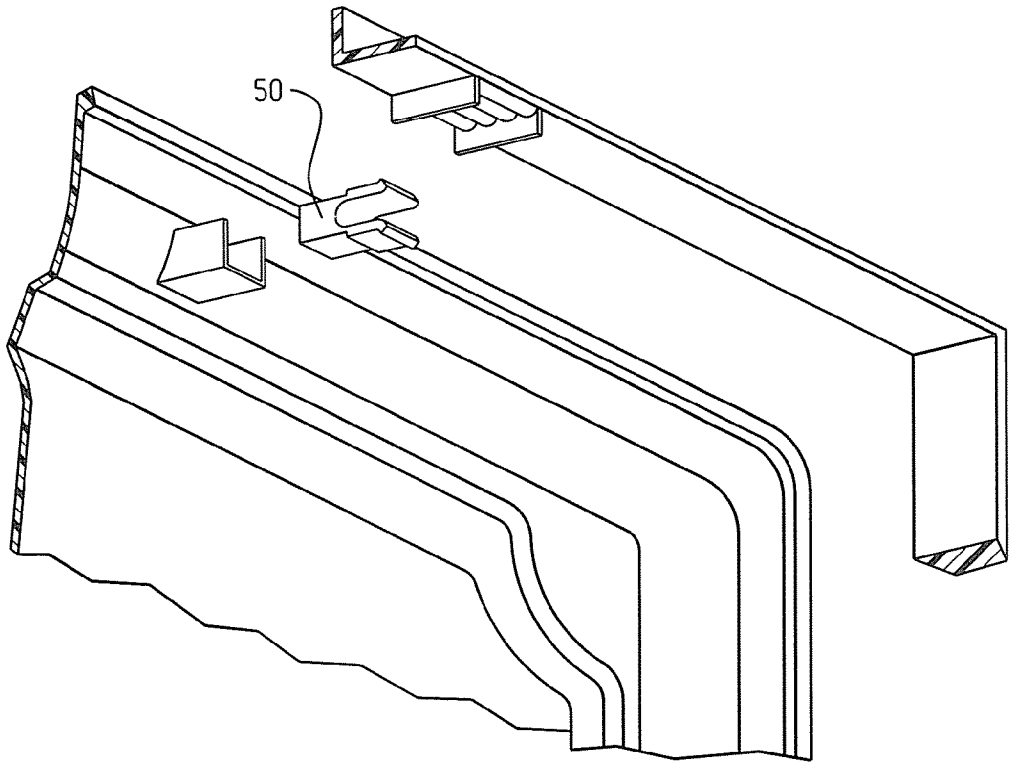
FIG. 7*b* is a perspective view of the clip of FIG. 7*a* in a system for aesthetically covering an access opening in a tub skirt.
Figure 7A:
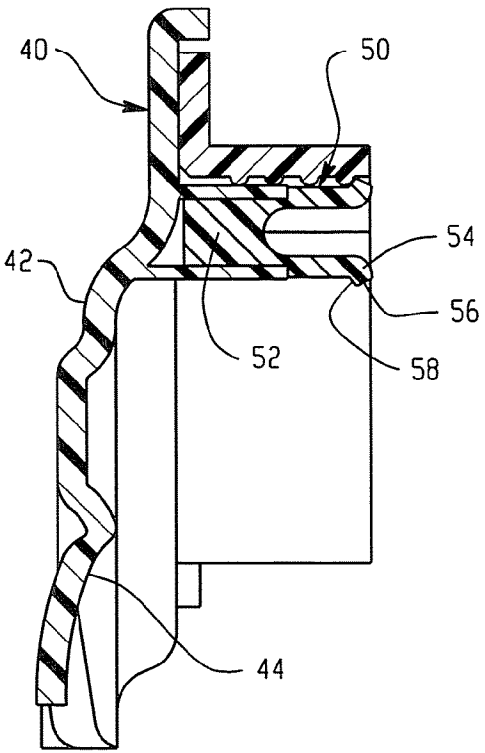
FIG. 7*a* is a cut away view of a clip within a system for aesthetically covering an access opening in a tub skirt.

Referring to FIGS. 1, 4*a*-4*c* and 7*a*-7*b* a panel 40 is provided which includes a face 42, back 44 and a plurality of clips 50. The face 42 preferably has a shape which is similar to the shape of the access opening 12 in the tub skirt 14, but is sized to cover the opening 12 when in place. The panel 40 may be formed from acrylonitrile-butadiene-styrene (ABS) or AES polymer: The face 42 of the panel 40 may be contoured for decorative purposes. The face 42 may also include raised portions. Extending from the back surface 44 are a plurality of clips 50. The clips 50 include a straight portion 52 which begins at the junction with the panel and extends to an end with an angled portion 54. The angled portion 54 may be any shape which defines a leading interactive surface 56 and trailing interactive surface 58 which mates with the mating surfaces 30 on the bracket 24. The leading interactive surface 56 and trailing interactive surface 58 may be pitched at equal angles but opposite directions with respect to the straight portion 52 to form a V-shape. The clips 50 may be molded integrally with the remainder of the panel 40 or attached in a separate process as shown in FIGS. 7*a* and 7*b*. The clips 50 are flexible, but resilient. The clips 50 interact with the mating surfaces 30 upon the bracket 24. The panel 40 may include a number of clips 50 which corresponds with the number and placement of mating surfaces 30 on the bracket 24. As the panel 40 is pushed into place the leading interactive surface 56 of the angled portion 54 of the clip 50 will engage the front side of a first raised ridge 32 upon the bracket. As the panel 40 is pushed further towards the bracket 24, the clip 50 flexes and travels over the raised ridge 32 to the ridge's back side. The panel 40 is now prevented from retraction by the trailing interactive surface 58 if released. As the panel 40 is pushed farther inwards, the clip 50 rides over each successive raised ridge until a desired position is reached. The panel 40 may also be removed easily. The panel 40 is pulled and the trailing interactive surface 58 of the clip 50 rides over successive raised ridges 32 as the resilient clip 50 deflects and returns to position. Thus, the clips 50 and the raised ridges 32 cooperate to permit bi-directional movement of the panel 40 relative to the bracket 24 or the tub skirt 14, to which the bracket may attach.

Although the invention has been shown and described with reference to certain preferred and alternate embodiments, the invention is not limited to these specific embodiments. Minor variations and insubstantial differences in the various combinations of materials and methods of application may occur to those of ordinary skill in the art while remaining within the scope of the invention as claimed and equivalents. Use of the term "or" herein is the inclusive, and not the exclusive use.

The invention claimed is:

1. A system for aesthetically covering access openings in a tub skirt when interior skirt access is not required comprising:

a bracket affixable to the tub skirt, the bracket comprising a plurality of fastener mating surfaces, each fastener mating surface comprising a plurality of raised ridges;

a panel easily attachable to and detachable from said bracket, said panel, when attached, hiding said bracket when viewed from the exterior of the tub skirt; and clips used to attach said panel to said bracket via engagement with at least one raised ridge of a corresponding fastener mating surface, wherein each raised ridge corresponds to a different position of the panel relative to the bracket;

and wherein the clips and the raised ridges cooperate to permit bi-directional movement of the panel relative to the bracket.

2. The system of claim 1 wherein said bracket extends around the perimeter of a portion of the tub skirt defining an access opening.

3. The system of claim 1 wherein said tub skirt is a skirt for a bath tub.

4. The system of claim 1 wherein said clips are integrally formed with and extend from the back of said panel.

5. The system of claim 4 wherein said clips include a straight portion and an angled portion.

6. The system of claim 5 wherein said angled portion of said clip includes a leading edge and a trailing edge together defining a V-shape.

7. The system of claim 1 wherein said mating surfaces are tapered from the front of said bracket to the back of said bracket.

8. The system of claim 1 wherein said bracket is a rectangular frame.

9. The system of claim 8 wherein said rectangular frame includes at least one fastener mating surface on at least two of its four sides.

10. The system of claim 9 wherein said rectangular frame includes at least one fastener mating surface on each of its four sides.

11. The system of claim 1 wherein said clips are detachable from said panel.

12. The system of claim 1, wherein the tub skirt is integrally formed with a tub.

13. The system of claim 1, wherein the tub skirt is separate from a tub and affixable over the top of the tub.

14. The system of claim 1, wherein the shape of the bracket is selected to be affixable around a periphery of the access opening.

15. The system of claim 1, wherein the bracket is affixed to the tub skirt with an adhesive.

16. The system of claim 1, wherein the panel is spaced apart from the bracket when attached.

17. The system of claim 1 wherein the different positions define different distances between the panel and the bracket.

18. A tub skirt comprising:

a face portion defining one or more access openings;

a bracket affixable to said skirt face portion;

a panel easily attachable to and detachable from said bracket, said panel, when attached, hiding said bracket when viewed from the exterior of the tub skirt; and at least two clips used to attach said panel to said bracket via engagement with corresponding mating surfaces comprising a plurality of raised ridges; wherein each one of said plurality of raised ridges corresponds to a different position of the panel relative to the bracket.

19. The tub skirt of claim 18, wherein the shape of the bracket is selected to be affixable around a periphery of the access opening.

20. The tub skirt of claim 18 wherein the different positions define different distances between the panel and the bracket.

21. A system for covering an access opening in a tub skirt, comprising a bracket capable of being affixed about a perimeter of the access opening and a panel attachable to and detachable from the bracket, wherein the panel is attachable to the bracket in a selected one of a plurality of positions, each position defining a different distance between the panel and the bracket, and wherein the panel is bi-directionally movable toward and away from the bracket.

22. The system of claim 21, wherein the panel comprises a plurality of clips designed to engage the bracket at a selected one of a plurality of positions.

23. The system of claim 22, wherein each clip comprises an angled leading edge and an angled trailing edge.

24. The system of claim 22, wherein the bracket comprises a plurality of raised ridges designed to engage the clip, each raised ridge capable of engaging the clip in a different selected position.

25. The system of claim 21 wherein the panel includes a plurality of sides, and each side includes at least one of the plurality of clips.

26. The system of claim 21 wherein said panel, when attached, hides said bracket when viewed from the exterior of the tub skirt.

* * * * *